US010138613B2

(12) United States Patent
Tng et al.

(10) Patent No.: US 10,138,613 B2
(45) Date of Patent: Nov. 27, 2018

(54) GROUND ANCHOR AND METHOD OF USING A GROUND ANCHOR

(71) Applicants: Eng Kiat Tng, Singapore (SG); Carrick Pierce, Alameda, CA (US)

(72) Inventors: Eng Kiat Tng, Singapore (SG); Carrick Pierce, Alameda, CA (US)

( * ) Notice: Subject to any disclaimer, the term of this patent is extended or adjusted under 35 U.S.C. 154(b) by 0 days.

(21) Appl. No.: 15/169,196

(22) Filed: May 31, 2016

(65) Prior Publication Data

US 2016/0356014 A1 Dec. 8, 2016

Related U.S. Application Data

(60) Provisional application No. 62/169,992, filed on Jun. 2, 2015.

(51) Int. Cl.

| | |
|---|---|
| ***E02D 5/80*** | (2006.01) |
| ***E02D 7/22*** | (2006.01) |
| ***E21D 21/00*** | (2006.01) |

(52) U.S. Cl.

CPC ..... *E02D 5/80* (2013.01); *E02D 7/22* (2013.01); *E21D 21/0046* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,096,574 A * | 7/1963 | Hillberg | ..... | E04G 17/0658 29/263 |
| 3,693,359 A * | 9/1972 | Karara | ..... | E21D 21/008 405/259.3 |
| 2011/0036025 A1* | 2/2011 | Boulay | ..... | E02D 5/801 52/157 |

FOREIGN PATENT DOCUMENTS

| | | | |
|---|---|---|---|
| GB | 1070692 | * | 6/1967 |

* cited by examiner

*Primary Examiner* — Sean D Andrish
(74) *Attorney, Agent, or Firm* — Weide & Miller, Ltd.

(57) ABSTRACT

An anchor member, spacers, nuts, anchor kits and methods of utilizing the same are provided. The anchor member has a threaded second end configured for engagement by a nut. In use, a first end of the anchor member is inserted in the ground with the second end extending out of the ground, such as through an aperture in a plate. One or more spacers are located over the anchor member. The nut is threaded onto the second end of the anchor member into engagement with the spacer(s). The threaded length of the second end of the anchor member and the length of the nut are selected to ensure a minimum desired contact distance and, in one embodiment, permit adjustability relative to the spacers.

13 Claims, 4 Drawing Sheets

GROUND ANCHOR AND METHOD OF USING A GROUND ANCHOR

RELATED APPLICATION DATA

The present invention claims priority to U.S. Provisional Application Ser. No. 62/169,992, filed Jun. 2, 2015.

FIELD OF THE INVENTION

The present invention relates to methods and devices used for ground reinforcement, such as rock and soil anchors.

BACKGROUND OF THE INVENTION

Ground anchors, such as rock bolts, tiebacks, spiles, micropiles and soil nails, etc., are commonly used for soil stabilization or reinforcement. These anchors generally utilize an elongate rod as the anchor member. Unfortunately, current ground anchors suffer from various drawbacks, including high costs, difficulty in installation due to the configuration of the anchor and the like.

An improved ground anchor which overcomes drawbacks of existing anchors is desired.

SUMMARY OF THE INVENTION

Aspects of the invention comprise anchor members, nuts for use with anchor members, spacers for use with anchor members, anchor kits and methods of using anchor members and anchor kits.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Aspects of the invention comprise anchor members, nuts for use with anchor members, spacers for use with anchor members, anchor kits, and methods of using anchor members and anchor kits. Other aspects of the invention comprise a method for locking an anchor member used in an earth retention and geotechnical system against a bearing surface. The anchor member of the invention may comprise a soil nail, ground anchor, micropile, rock bolt or comprise other members used in earth retention and geotechnical construction.

Figure 1A:
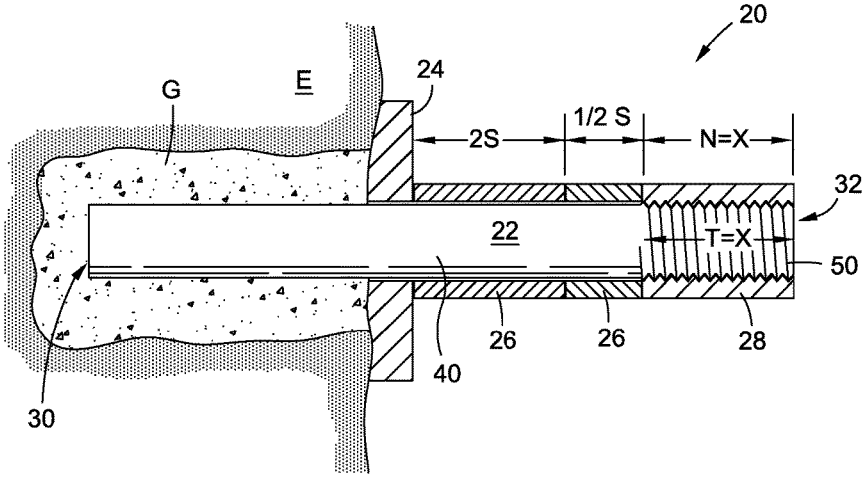
FIG. 1A is a cross-sectional side view of a ground anchor in accordance with a first embodiment of the present invention, the application of the ground anchor including a first configuration of spacers.

FIG. 1A illustrates a ground anchor 20 in accordance with one embodiment of the invention. Aspects of the ground anchor 20 comprise (but are not required to include) an anchor member 22, a plate 24, one or more spacers 26, and a nut 28. As indicated herein, various of the elements of the ground anchor 20 may be used apart from one another and/or in combination with other elements or devices.

In general, in use of this embodiment ground anchor 20, a first end 30 of the anchor member 22 is located in a desired location, such as in a bore formed in the ground E (which may comprise rock, sand, soil, etc.) The anchor member 22 is inserted to a desired depth, with a second end 32 of the anchor member 22 extending out of the ground E. Preferably, grout G is injected around the portion of the anchor member 22 in the ground E, such as to fill the bore around the anchor member 22.

In the illustrated embodiment, the plate 24 is positioned at or near the surface of the ground E. The anchor member 22 extends through an opening or aperture in the plate 24. In other embodiments, the anchor member 22 may be used without a plate 24.

The nut 28 is threaded onto the second end 32 of the anchor member 22. The nut 28 is configured to engage one or more spacers 26 which are placed over the anchor member 22 between its second end 32 and the plate 24 (or the ground or other supporting surface or element if a plate is not utilized). Optionally, a force is applied to the anchor member 22 as part of placing the anchor member 22 and securing the nut 28 (although generally the force is generated by loading placed onto the anchor member 22 due to movement of the ground E over time).

FIG. 1A illustrates one embodiment of an anchor member 22 in accordance with the present invention. In this embodiment, the anchor member 22 comprises an elongate body 40 having a first end 30 and a second end 32. In this embodiment, threads 50 are located at the second end 32 of the body 40. Preferably, the reminder of the body 40 is unthreaded. However, in other embodiments, other portions of the body 40 might be threaded, but preferably some portions (and most preferably, a substantial portion) of the body 40 is unthreaded. The elongate body 40 is usually deformed to allow for a bond between the body 40 and grout G and/or the body 40 and the ground E.

In one embodiment, the body 40 is constructed from metal. The body 40 may have various shapes, but in a preferred embodiment it is round in cross-section and, as illustrated in the figures, including FIG. 1A, has a generally constant diameter.

As indicated, the ground anchor 20 may include at least one nut 28. The nut 28 comprises a body defining a passage there through. At least a portion of the passage is threaded to permit threading engagement of the nut 28 with the anchor member 22. The nut 28 has a first end and an opposing second end and an exterior.

An important aspect of the invention is the length of the threads or threaded portion of the anchor member 22 at the second end 32 thereof and the length of the engaging nut 28. As indicated, the second end 32 of the anchor member 22 bears threads 50 (and preferably the remainder of the body 40 does not bear or include threads, although as indicated above, it is possible for other portions of, but not all of, the body 40 to bear threads). The threads 50 preferably extend from a distal end of the anchor member 22 along the second end 32 a distance T. This allows a nut 28 having a length N (where N preferably signifies the threaded length of the nut) to be threaded onto the anchor member 22. In one embodiment, the distance T (of the threads) on the anchor member 22 and the length N of the nut are both a distance or length X. A typical value of X is a minimum engagement distance required between the nut and the threads on the anchor member so that the failure of the anchor system is NOT due to the nut stripping off the threads but is instead due to the failure of the bar. However, the distance T of the threads on the anchor member 22 and/or the length N of the nut may be greater than X, such as described below (and the distance T and length N need not be the same).

FIG. 1A illustrates an embodiment of the anchor 20 where the distance T is selected to be equal to X and the length N of the nut 28 is also X.

Additional aspects of the invention will be appreciated from a further description of the anchor 20 and its use.

As indicated herein, in one embodiment the anchor 20 may include a plate 24. The plate 24 may have various configurations. In a preferred configuration, the plate 24 is a generally planar body having one or more apertures there through which are sized to accept the anchor member 22.

Preferably, the one or more spacers 26 are configured to fit over at least a portion of an anchor member 22. Each spacer 26 may comprise a body having a passage therethrough for accepting the anchor member 22. As illustrated in the figures, including FIG. 1A, the passage through each spacer 26 is preferably unthreaded and is sufficiently large to permit the spacer to be slid over and along the anchor member 22, as described in more detail below. As described below, spacers 26 of the invention may have different sizes, such as different lengths or thicknesses.

As illustrated in FIG. 1A, in one embodiment of a method of using a ground anchor 20, an anchor member 22 is positioned so that the first end thereof 30 is located in the ground E (or other desired location/material, such as rock, sand, etc.). Preferably, the anchor member 22 is positioned so that a second end 32 thereof extends out of the ground E. The first end of the anchor member 22 may be set or anchored, such as by injecting grout around the anchor member or by other means.

In one embodiment, a plate 24 may be located over the anchor member 22 or the anchor member 22 is passed through the plate 24. The plate 24 is preferably located at or near the surface of the ground E or is otherwise supported. As indicated above, in other embodiments of the invention, a plate 24 is not required and/or need not be utilized.

In one embodiment, a nut 28 is threaded onto the second end 32 of the anchor member 22. Generally, it is desired for the nut 28 to securely engage the anchor member 22 (e.g. engage the anchor member 22 by a required mechanical distance, as described herein) and directly or indirectly engage a bearing surface (such as the ground, or if a plate 24 is used, the plate 24)

In many instances, such as illustrated in FIG. 1A, the anchor member 22 extends out of the ground a sufficient distance that the nut 28 cannot be threaded down the anchor member 22 until it engages the bearing surface, due to the limited distance which the anchor member 22 is threaded. Thus, in a preferred embodiment of the invention, one or more spacers 26 are utilized.

In one embodiment, as indicated above, the spacers 26 comprise bodies which define a passage for receiving the anchor member 22. Each spacer 26 has a first end, an opposing second end and an exterior surface. The spacers 26 may comprise annular bodies (e.g. generally cylindrical in shape), but they may have other exterior shapes. The spacers may have one or more predetermined lengths. For example, in an anchor kit, the kit might comprise the anchor member 22, optionally the plate 24, the nut 28 and a plurality of spacers 26 having different lengths.

Preferably, the user places one or more spacers 26 onto the anchor member 22 (by extending them over the second end 32 of the anchor member 22). A first or bottom end of the first spacer 26 which is located on the anchor member 22 is positioned so that it engages the bearing surface (e.g. soil, plate 24, etc.).

Preferably, the user places one or more spacers 26 over the anchor member 22 until they reach (or are generally proximate to) the threaded portion 50 of the anchor member 22. Advantageously, spacers 26 of different lengths allows the user to make combinations of spacers which correspond to the distance between the plate 24 (or ground, etc.) and the threads at the second end of the anchor member 22 (which distance may vary from anchor member to anchor member, such as due to variability in anchor member length and/or insertion depth into the ground). The user then places the nut 28 onto the anchor member 22 and tightens the nut 28 against the spacers 26. In some instances, or optionally, the user may apply a force to the anchor member 22 by creating a force against the ground E (such as via the plate 24), which is counter-acted by the anchor member 22.

FIG. 1A illustrates a configuration in which the user utilized two spacers 26, one having a length of S and another having a length of ½S. A nut 28 having a length N=X is fully threaded onto the anchor member 22 with threads 50 having a length T=X.

Figure 1B:
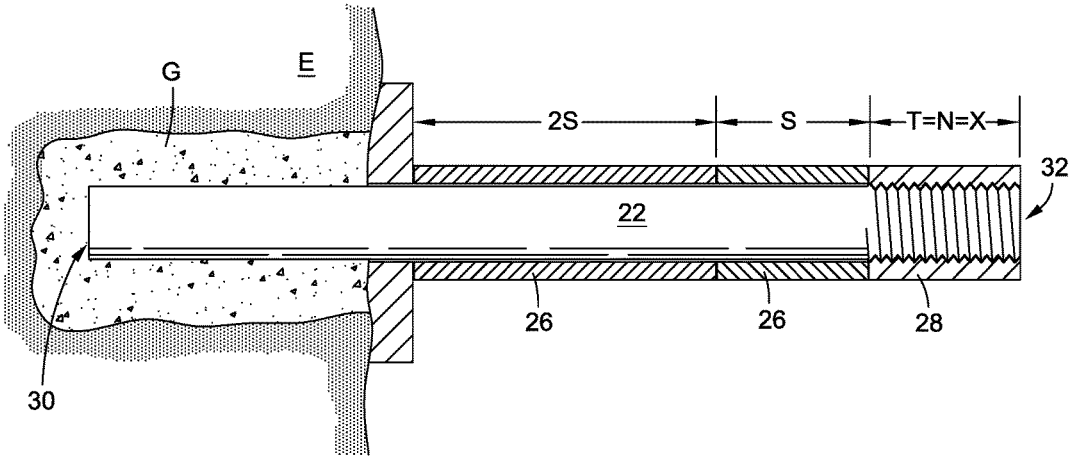
FIG. 1B is a cross-sectional side view of a ground anchor in accordance with the first embodiment of the present invention where the application of the ground anchor includes a second configuration of spacers.

FIG. 1B illustrates a similar configuration where the user utilized a first spacer 26 having a length 2S and a second spacer having a length S, and then threaded the nut 28 onto the anchor member 22.

Figure 2A:
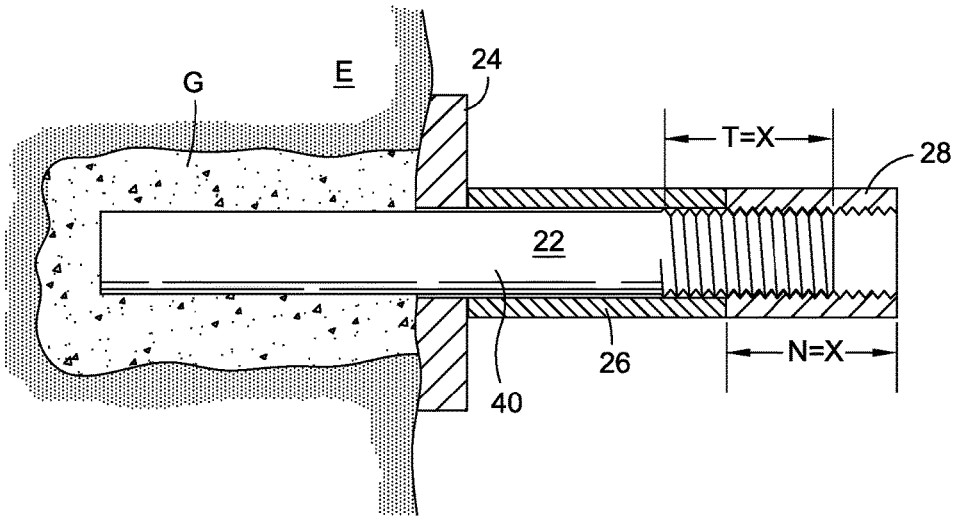
FIG. 2A is a cross-sectional side view of a ground anchor in accordance with the first embodiment of the present invention where the application of the ground anchor includes a third configuration of spacers.
Figure 2B:
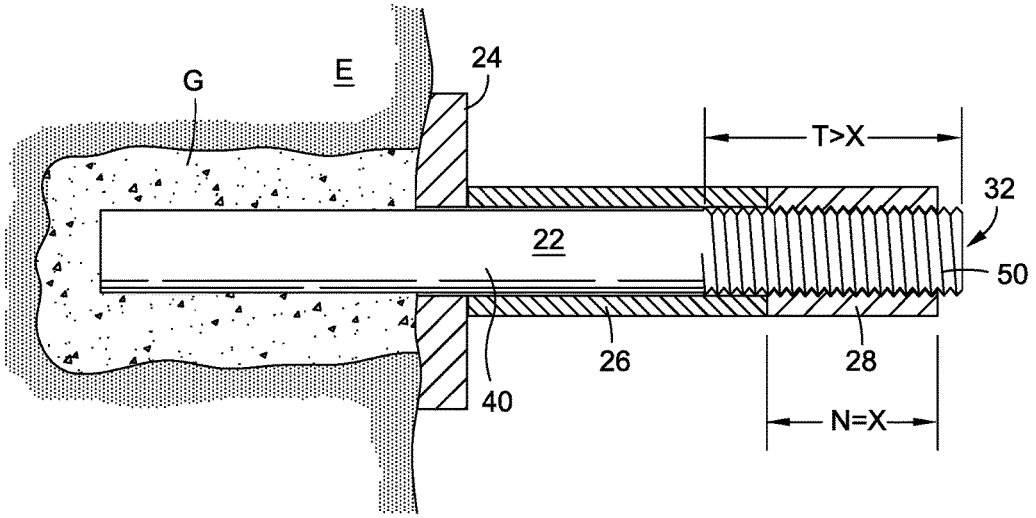
FIG. 2B is a cross-sectional side view of a ground anchor in accordance with a second embodiment of the invention.

One variation of the invention will be described with reference to FIGS. 2A and 2B.

In the case where X is the minimum engaging distance between the nut 28 and anchor member 22 so that failure of the anchor system is not due to the nut stripping off of the threads on the anchor member, in the case where the length of the nut N=X and the thread length T=X, the nut must generally be fully threaded or engaged with the threads on the anchor member. FIG. 2A illustrates an undesirable configuration where when one or more available spacers 26 are located on the anchor member 22, the nut 28 having a length N=X cannot be threaded onto the threads 50 having a length T=X on the anchor member 22 the minimum engaging distance X (which is required to ensure that the nut does not strip off of the threads under load as described herein; the only time this is not the case is when the design load is less than the load required to strip the threads based upon the engagement length shown).

In order to address this undesirable condition, the threads 50 may extend along the anchor member 22 a distance of T where T is greater than the minimum engaging distance X (but where the threads 50 do not extend along the entire length of the bar). Thus, as illustrated in FIG. 2B, the added thread distance permits the use of one or more spacers 26 which overlap some portion of the threads 50, but still permits the nut 28 to be threaded onto the anchor member by the desired minimum distance of X. In accordance with this embodiment of the invention, by using differing combinations of spacers 26 and due to the adjustability permitted by the nut/anchor member engagement (due to the relative thread distances), the user can ensure that the nut engages the spacer(s) such as to apply/generate a loading force, and that the nut 28 and anchor member 22 are securely engaged, without requiring that the entire anchor member be threaded, as is undesirably the case in the prior art.

Figure 2C:
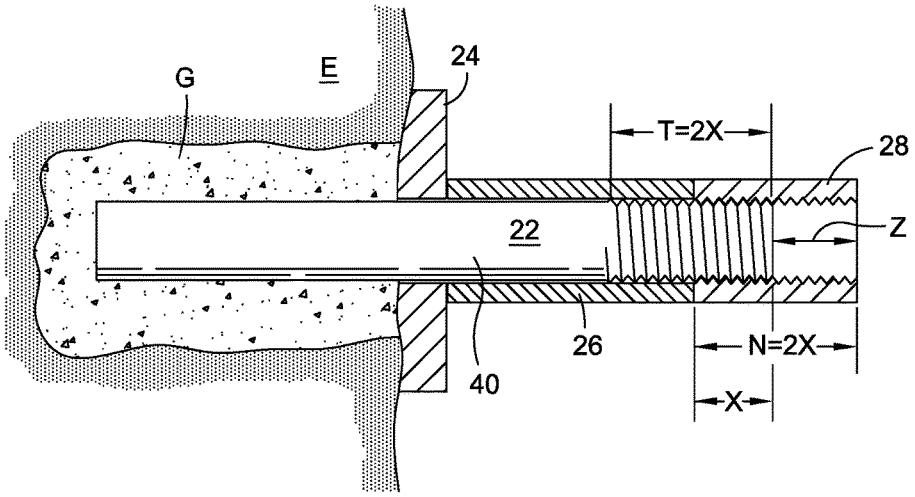
FIG. 2C is a cross-sectional side view of a ground anchor in accordance with a third embodiment of the invention

In one preferred embodiment of the invention, T and N are both equal to, or greater than, 2X. In other words, the length of the threaded portion of the anchor member 122 and the length of the engaging portion of the nut 128 are both at least twice as long as the minimum engaging distance. Advantageously, this allows the nut 128 to engage the anchor member 122 by at least a distance of X while leaving "play" (e.g. a distance that the nut may not engage or overlap with the anchor member) of a distance X, as illustrated in FIG. 2C. One particular advantage of this configuration is that a user can verify that the nut 128 is engaging the anchor member 122 by the minimum engaging distance of X by measuring the distance between the end of the nut 128 and the end of the anchor member 122. If that distance Z is less than or equal to X, then given that the nut length is 2X, this confirms that the nut 128 is engaging the anchor member 122 by the minimum distance of X.

Figure 3:
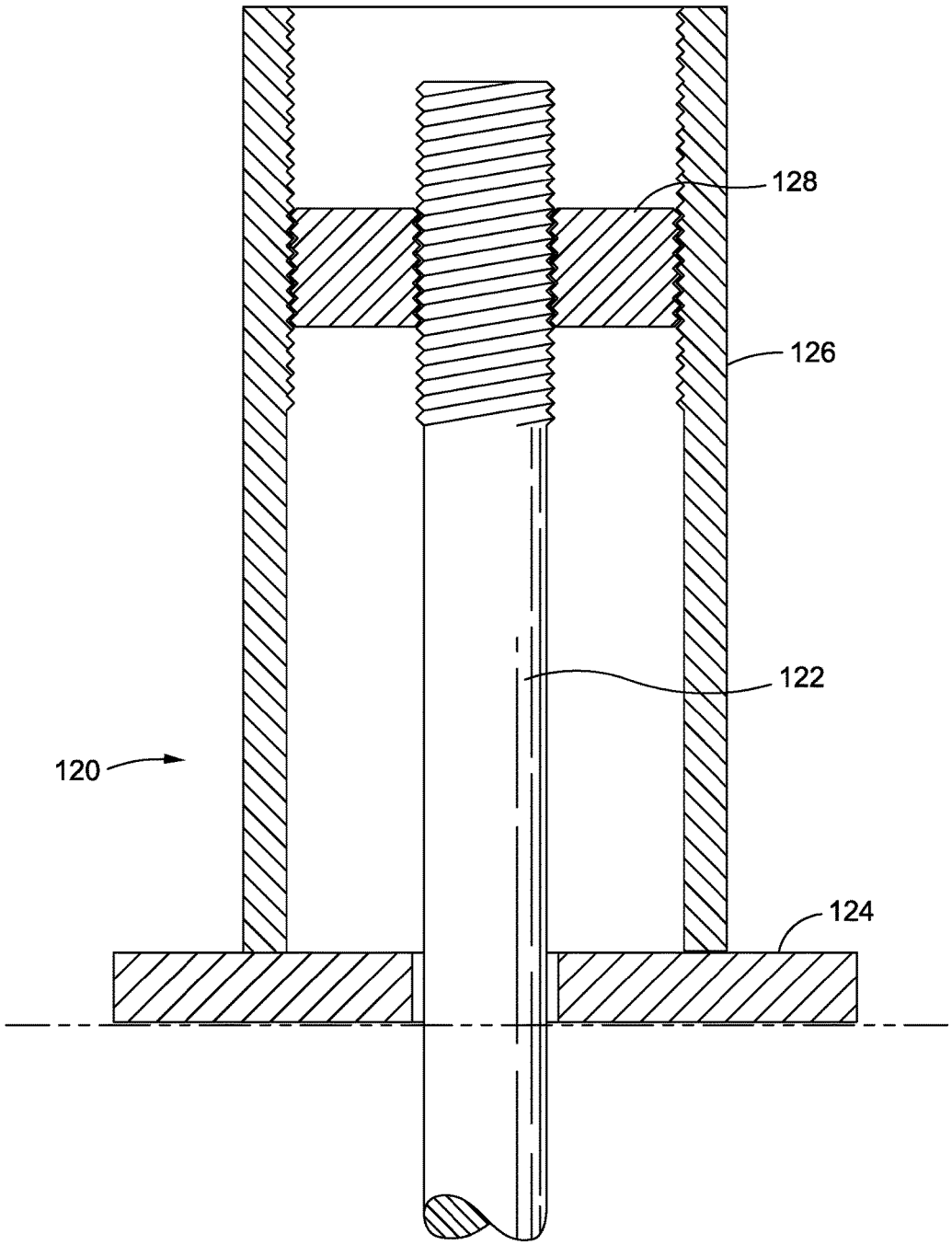
FIG. 3 illustrates a cross-sectional view of a ground anchor in accordance with yet another embodiment of the invention.

Another embodiment of the invention is illustrated in FIG. 3. In this embodiment, the anchor 120 comprises an anchor member 122, a plate 124, at least one spacer 126 and nut 128 (again, the plate 124 is not required). In this configuration, the nut 128 again engages threads at a second end of the anchor member 122. In addition, the spacer 126 extends between the nut 128 and the plate 124 (or ground or other supporting element/surface). However, in this embodiment, the exterior of the nut 128 is threaded for engagement with threads on an interior of the spacer 126, whereby the spacer 126 (more than one spacer could again be utilized) is threaded over the nut 128 until it engages the plate 124.

One aspect of the invention comprises an anchor kit. Preferably, the kit includes at least one anchor member 22, at least one nut 28 and at least one spacer 26. The kit may include at least one plate 24 and, in one or more embodiments, preferably includes multiple spacers 26.

While the spacers illustrated herein have ends which are flat, e.g. perpendicular to their elongate axis, one or more of the spacers may have one or both ends which are angled. This permits, for example, use of spacers with an anchor member which extends out of a plate at an angle offset from perpendicular (e.g. "wedges"). Also, one or more spacers may comprise washers. For example, a washer may be located between the ground or plate and one or more spacers.

Of course, other configurations of the invention are possible wherein the possible range of engagement between the nut and the anchor member is limited, but spacers or other elements are used to transfer an applied force to the anchor member via the ground or other supporting structure/surface, such as a plate.

As one example, in another embodiment of the invention, a Lenton® type coupling may be utilized for the anchor member and nut, wherein the threaded second end of the anchor member may be tapered and a corresponding tapered nut may be threaded onto the anchor member. Again, such an anchor configuration may optionally utilize a plate. One or more spacers are preferably utilized between the nut and the ground/plate.

Figure 2D:
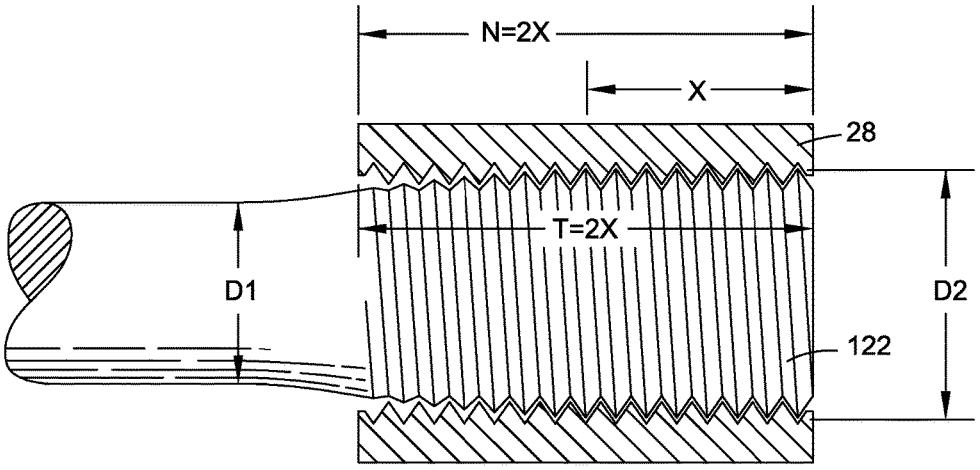
FIG. 2D is a cross-sectional side view of a ground anchor in accordance with a fourth embodiment of the invention.

As illustrated in FIG. 2D, the principles of the invention may also be applied to anchor members which have an enlarged head at the second end (which enlargement is used to increase the strength of the anchor member at that location to offset the reduction in strength resulting from the threads). As illustrated, such an anchor member 22 may have a diameter D2 at the second end thereof, which diameter D2 is greater than the diameter D1 of the remaining/main portion of the anchor member. In particular, the principles of the invention can be used to ensure that the engagement distance of the nut with the threads on the enlarged head of the anchor member 22 is equal to or greater than X (e.g. the length or distance of the threads T on the anchor member 22 are selected, in combination with the threaded length N of the nut 28, to ensure the minimum engaging distance X—even though some of the threads on the anchor member 22 might not be full-depth engaged by the nut 28 because they are in a sloping transition zone between the enlarged head or are on the smaller diameter (D1) portion of the anchor member adjacent to the head where the threaded diameter is too small to be fully engaged by the nut).

The present invention has applicability to a wide range of applications, such as foundations, soil reinforcement, earth retention, slope stabilization and tunneling, among others.

Various embodiments of the invention are described above. It will be appreciated that the invention may have other configurations. In general, it will be appreciated that the anchor member of the invention preferably has threads located at a second end thereof for engagement with a nut. The threaded distance of the anchor member and the threaded distance of the nut are preferably greater than or equal to a minimum thread distance which is required to develop the desired strength/load capacity of the anchor to nut connection. Most preferably, the thread distance of the anchor is greater than that of the nut, thus allowing the position of the nut to be adjusted along the anchor (while still maintaining at least a minimum distance of engagement, and thus the minimum required strength/load capacity of the anchor to nut connection).

At the same time, a particular advantage to the invention is that the anchor member does not need to be entirely threaded. In a preferred embodiment of the invention, threads are located only at one or both ends of the anchor member, resulting in maximum reduction in the cost of producing the anchor member. At the same time, adjustability which is required to permit the anchor member to be used in different applications is easily accommodated by utilizing one or more spacers.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A ground anchor kit comprising:

a generally planar support plate having a top side and a bottom side, an aperture extending through said support plate and said bottom side configured to be placed against a surface of the ground;

an anchor member having a generally constant diameter, a first end and an opposing second end, and a threaded portion and an unthreaded portion, said threaded portion extending along said second end a distance T, where said distance T is equal to a distance 2X, where X comprises at least a minimum distance of engagement with a nut to sustain desired loading of said anchor member and said unthreaded portion having a length which, when said first end is located in said ground, extends through said aperture in said support plate whereby said threaded portion is spaced outwardly from said top side of said support plate;

a plurality of spacers, each of said plurality of spacers having a first end and a second end and an unthreaded interior passage for accepting at least a portion of said anchor member, a length between the first end and the second end of at least two of said plurality of spacers being different, the plurality of spacers comprising at least a first spacer and a second spacer selectable from said plurality of spacers so that said at least a first spacer and a second spacer extend over the unthreaded portion of said anchor member extending outwardly from said top of said support plate when said first end of said first spacer is positioned along said anchor member towards said first end thereof and is located against said top side of said plate and the second end of said second spacer extends to or at least partially overlaps said threaded portion of said anchor member; and said nut comprising a body having a passage there through, said passage having threads extending at least a distance N, where distance N is greater than or equal to said distance X, said threads configured to engage with said threads on said second end of said anchor member and engage said second end of said second spacer.

2. The kit in accordance with claim 1 wherein said distance N=said distance X.

3. The kit in accordance with claim 1 wherein said distance N is equal to said distance 2X.

4. The kit in accordance with claim 1 wherein said plurality of spacers comprise at least a first spacer having a length S and at least a second spacer having a length S/2.

5. The kit in accordance with claim 1 wherein said distance N is less than the distance T.

6. The kit in accordance with claim 1 wherein said anchor member is generally cylindrical in shape.

7. The kit in accordance with claim 1, wherein said anchor member has a generally constant first diameter except at said second end, said second end having a second diameter which is greater than said first diameter.

8. A method of installing a ground anchor comprising the steps of:

locating a support plate on a surface of the ground;

locating an anchor member having a generally constant diameter, a first end and an opposing second end, and a threaded portion at said second end and an unthreaded portion comprising a remainder of said anchor member so that said anchor member extends through an aperture in said support plate, with said first end of said anchor member located in the ground and said threaded portion and at least a portion of said unthreaded portion extending outwardly above said support plate;

placing at least one first spacer over said second end of said anchor member and along said anchor member so that at said least one first spacer extends over said portion of said unthreaded portion of said anchor member extending out of said ground with a first end of said at least one spacer engaging said support plate and a second end of said at least one first spacer or an end of a second spacer extends over at least a portion of said threaded portion of said anchor member;

engaging a threaded nut with said second end of said anchor member; and tightening said threaded nut against said at least one first spacer to press said at least one first spacer downwardly along said anchor member against said support plate.

9. The method in accordance with claim 8 wherein said nut is engaged with said threaded portion of said anchor member by at least a distance X which is a minimum desired contact distance between said nut and anchor member to sustain desired loading there between.

10. The method in accordance with claim 9 wherein said nut comprises a body having a passage therethrough, said passage having threads extending at least a distance N, where N is greater than or equal to a distance X.

11. The method in accordance with claim 8 wherein said threaded portion of said anchor member has a length T where T is greater than or equal to a distance X which comprises at least a minimum distance of engagement with said nut to sustain desired loading of said anchor member and no greater than a distance 2X.

12. The method in accordance with claim 8 wherein a length between the first end and the second end of at least two of said at least one first spacers is different.

13. The method in accordance with claim 8, wherein said anchor member has a generally constant first diameter except at said second end, said second end having a second diameter which is greater than said first diameter.

* * * * *